United States Patent [19]

Moner

[11] Patent Number: 4,893,107

[45] Date of Patent: Jan. 9, 1990

[54] AXIAL MINIATURE FUSE WITH PLASTIC MOLDED BODY

[75] Inventor: John M. Moner, Ballwin, Mo.

[73] Assignee: Cooper Industries, Inc., Houston, Tex.

[21] Appl. No.: 139,359

[22] Filed: Dec. 30, 1987

Related U.S. Application Data

[63] Continuation-in-part of Ser. No. 31,489, Mar. 27, 1987, abandoned.

[51] Int. Cl.[4] ..... H01H 85/02

[52] U.S. Cl. ..... 337/186; 174/52.2; 337/205

[58] Field of Search ..... 337/414, 186, 205, 251, 337/252, 241, 246; 174/52 PE

[56] References Cited

U.S. PATENT DOCUMENTS

| | | | |
|---|---|---|---|
| 3,254,282 | 5/1966 | West | 174/52 PE |
| 3,914,863 | 10/1975 | Wiebe | 337/246 |
| 4,164,725 | 8/1979 | Wiebe | 337/252 |
| 4,385,281 | 5/1983 | McAlear et al. | 337/414 |

*Primary Examiner*—H. Broome

*Attorney, Agent, or Firm*—David Alan Rose; Ned L. Conley; Donald Verplancken

[57] ABSTRACT

An improved electrical fuse having axial leads (5) and comprising a fuse wire in a cylindrical sleeve (2) supported at its ends by lead carrying end caps (3) is coated over the length of the fuse body by an insulating layer of thermo-plastic (7). Improved humidity resistance and mechanical strength are achieved and control of coating thickness is improved. Use of hot plastic for the insulating layer (7) reflows solder joint (4) reducing instances of open or high resistance fuses which must be rejected. Also, the $I^2t$ performance is significantly improved over other adherent coatings.

13 Claims, 2 Drawing Sheets

AXIAL MINIATURE FUSE WITH PLASTIC MOLDED BODY

This application is a continuation-in-part of Ser. No. 031,489 filed Mar. 27, 1987, now abandoned.

The present invention relates to an improvement in electrical fuses.

BACKGROUND OF THE INVENTION

Cartridge type electrical fuses having axial leads have been long known in the fuse art. The fuse element in such a fuse is typically a fusible wire centrally supported within a cylindrical sleeve forming a casing for the fuse. To insure reliable fusing it is essential that the fuse wire must not touch the interior wall of the sleeve along its length, hence, the ends of the fuse wire are supported in such a manner as to prevent such contact. External lead carrying end caps having solder therein are used to capture the fuse wire ends folded over the outside of the sleeve ends. Final mechanical assembly consists of press fitting the end caps over the folded-over ends of the fuse wire followed by momentary heating of the solder to obtain good electrical connection between the fuse wire and the end caps.

Since the fuse casing formed by the sleeve must form an insulated body, typically made of ceramic or glass, which cannot be easily solder bonded, the only substantial opposition to the separation of the end caps from the sleeve is derived from the pressure fitting of the end caps over the outer surface of the sleeve. Thus, such fuse structures are generally weak in tension, and are prone to mechanical failure on a pull test applied to the end leads. Such structures are prone to humidity induced corrosion problems because of the exposed metal end caps and the lack of any hermetic sealing.

Another problem with cartridge fuses is that a certain percentage of the fuses are defective due to failure to obtain good electrical connections between the fuse link and the end caps during the soldering process. These fuses must, of course, be discarded or reworked.

One prior art solution to the above problems comprises the application of a length of heat-shrinkable plastic tubing over the sleeve and end caps, the tubing overlapping, although loosely, the inner end of the leads and extending outwardly from the end caps. The heat shrunk tubing provides some improvement in fuse strength and provides a moderately good sealing for the fuse interior. A disadvantage of this construction is that the cap ends are exposed to the external ambient conditions, owing to the fact that the limited shrinkage capability of the tubing prevents a desired end cap sealing engagement of the heat shrunk tubing with the leads. Thus, it is necessary to plate the end caps to secure adequate corrosion resistance for these elements. The resulting structure is still not adequately strong, in that a moderate pull on the leads can still shift the end caps to break the fuse wire. Also, this type of fuse construction has no effect on the fuses which are defective due to improper solder connections.

Another prior art fuse which attempts to solve some of the above problems is comprised of a cartridge fuse having an insulating sleeve, end caps, and the adjacent portions of the power leads extending therefrom, coated with a high bond strength insulating material, as, for example, an epoxy material. Such a fuse is shown in U.S. Pat. No. 4,385,281. The bonded insulating coating covers and anchors the end caps to the casing-forming sleeve. However, problems with fuses defective to poor solder connections are still present and epoxy, which is a thermo-setting plastic material, will often crack or shatter at high temperatures.

BRIEF SUMMARY OF THE INVENTION

According to the present invention, a cartridge fuse comprised of a hollow cylindrical insulating body, end caps or ferrules enclosing the ends of the insulating cylinder, a fusible link connecting the ferrules, and leads attached to the ferrules for conducting current to and from the fuse, are encased in a high temperature insulating plastic. The insulating plastic is applied by insert injection molding and raises the temperature of the cartridge fuse to a temperature high enough to cause reflow of the solder joint connecting the fusible element and the ferrules or end caps. Thus, defective fuses due to improper solder connections in the manufacturing process are essentially eliminated. Additional benefits derived from the use of injection molded plastic coatings for cartridge fuses are an increase in the dimensional stability of the end product and a significant increase in the performance of the fuse, both in mechanical strength on fuse failure, and improved short circuit performance.

DETAILED DESCRIPTION OF THE INVENTION

Figure 1:
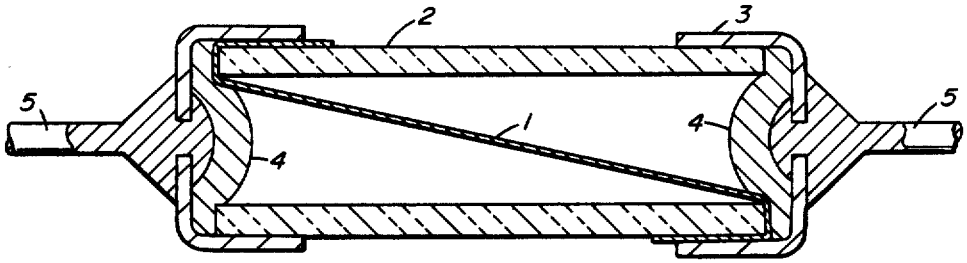
FIG. 1 (PRIOR ART)
FIG. 1 is a partial longitudinal sectional view of a cartridge fuse.

Referring to the prior art fuse of FIG. 1, a length of fuse wire 1 is held captive at the ends of an initially open ended cylindrical sleeve 2 by means of a pair of cup-shaped end caps 3—3 having cylindrical interior recesses for receiving the ends of the sleeve 2 with a pressure fit. A body of solder 4 in each end cap 3 is heated to wet the fuse wire and secure it to the end caps 3—3. Shouldered connecting leads 5—5 pass through the center of the caps 3—3 and are secured by staking prior to assembly to the fuse structure.

Figure 2:
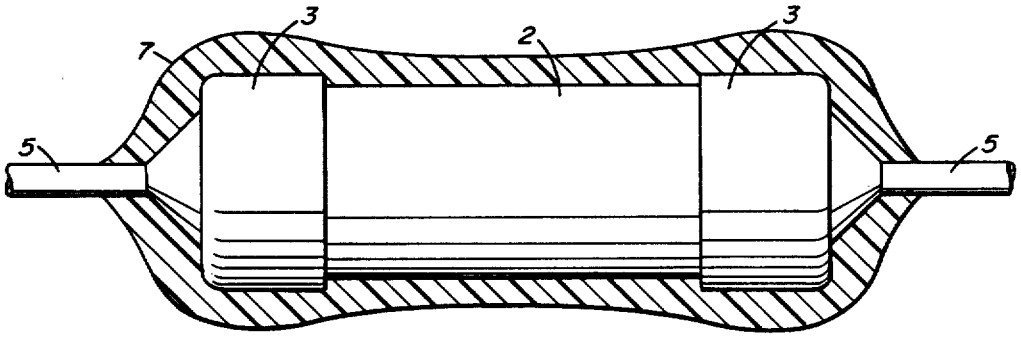
FIG. 2 is a partial cross-sectional elevation of a fuse as shown in FIG. 1, after the high bond strength plastic coating has been applied.

FIG. 2 shows the preferred form of the invention, wherein the fuse of FIG. 2 is coated with a high-bond strength plastic material or the like to achieve improved structural strength and a complete sealing of the sleeve 2 and end caps 3—3 against the adverse affects of moisture. In the preferred form of the invention the fuse is held in a mold and a thermo-plastic material is injected into the mold surrounding the cartridge fuse. This process is known as injection molding and is well-known in the art.

A number of plastics available commercially are suitable for use in practicing this invention. However, in order to cause reflow of the cap solder 4, the plastic should be injection molded at a temperature above approximately 220° F. Thermo-setting plastic materials such as epoxy will not provide performance results like those that are achieved with thermo-plastics. In particular, the thermo plastic employed in the present invention is polyphenylene sulfide, although other thermoplastics will also work.

Use of injection molded plastic coatings has been found to have several significant beneficial effects. For example, using a mold with injection plastic, tolerances for the cylindrical body have been achieved on the order of ±0.002 inches. This compares to prior art tolerances of approximately ±0.02 inches using epoxy coatings.

Another improvement found with using injection molded plastic bodies has been an increase in the impact and flexural strength of the fuses. It has been found that plastic molded bodies such as described above can withstand the internal pressure generated inside a fuse during a 125 v, 50 amp, 97% power factor short circuit. Internal pressures generated by such an overload will usually cause rupture of an epoxy fuse. This is perhaps due to the lower structural strength of epoxy coatings.

Figure 3:
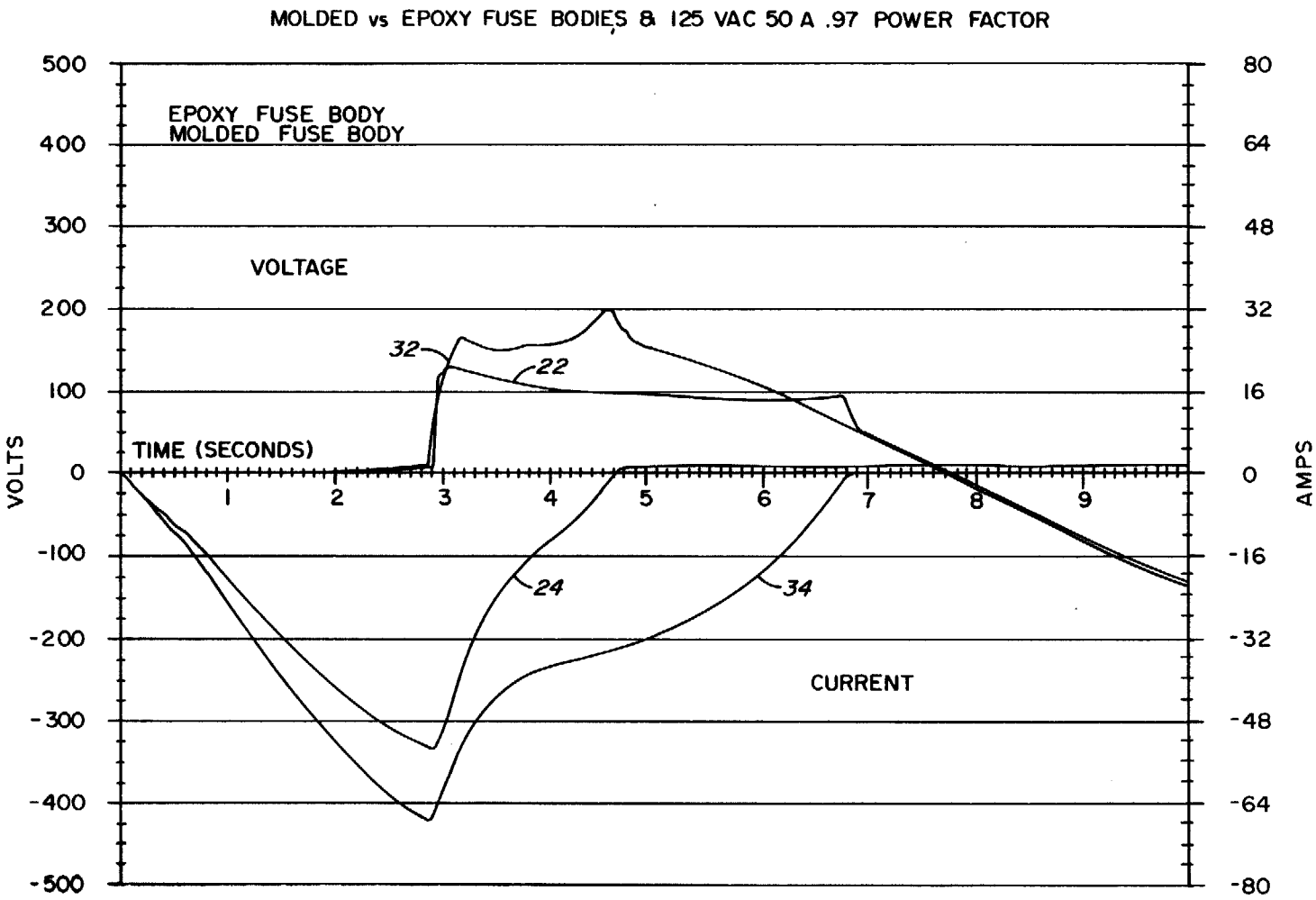
FIG. 3 is a graph showing the performance characteristics of a prior art fuse and a fuse according to the present invention.

A new and somewhat unexpected benefit of a plastic coated fuse as compared to prior art sleeve-type fuses and fuses coated with epoxy has been a significantly improved short circuit performance. As shown in FIG. 3, the performance of a plastic molded body fuse is appreciably better than the comparable performance of an epoxy coated fuse. In the tests that produced the graph results in FIG. 3, an epoxy coated fuse and a plastic coated fuse according to the present invention were subjected to a short circuit test in which 50 amps AC at 125 v and 97% power factor, or essentially purely resistive circuit, were applied across the fuse. The voltage across and current through the plastic molded body fuse are shown at 22 and 24 respectively. The voltage across and current through an epoxy coated fuse are shown at 32 and 34 respectively. The most important information shown by these curves is the $I^2t$ value from the point at which the fuse opens. This value is represented by the area under the current curve for each particular fuse from the point where it begins its short break in an upward direction. In this particular test, the total $i^2t$ energy for the plastic molded body fuse was approximately 4.38 $amps^2$ seconds and for the epoxy coated body, approximately 9.53 $amps^2$ seconds.

In conclusion, it may readily been seen that a plastic molded body fuse has significantly improved short dircuit performance, causes reflow of the solder joint during manufacture to reduce the number of rejected fuses, provides increased structural strength, and seals the fuse against moisture and humidity.

While the specific embodiment described is the preferred embodiment, it is readily apparent that other alterations may be made which fall within the scope of the present invention. For example, other high temperature materials other than plastic may be used which will cause reflow of the solder joint and provide structural strength and integrity to a cartridge type fuse or other type of fuse.

I claim:

1. A fuse comprising:

an oppositely open ended insulating housing in the form of a cylindrical sleeve;

a fusible element disposed within said housing;

a pair of end cap means closing the ends of said sleeve, securing the ends of said fusible element and making electrical contact thereto, each of said cap means being cup-shaped to provide a cylindrical recess to accommodate an end of said sleeve and having an external lead connected thereto and extending outwardly therefrom for making external electrical connection to said fusible element; each of said cap means containing a quantity of solder fused to make electrical contact between said end cap means and said ends of said fusible element, said fusible element extending diagonally across the length of said sleeve housing and having a portion of each of its ends exiting the open ends of said sleeve and folded back over a portion of the external surface of said sleeve to be located between the sleeve ends and the end cap means; and an insulating high temperature, resilient coating layer disposed over said sleeve, end cap means and leads to cover, seal, and physically interconnect the exposed exterior surfaces of said sleeve, said pair of end cap means, and a portion of each of said leads adjacent to said pair of end cap means.

2. A fuse as in claim 1 wherein said high temperature resilient coating layer is thermo-plastic.

3. A miniature fuse, comprising:

an insulative body portion having a cavity therein;

conductive caps disposed on said body portion enclosing said cavity;

a fuse wire disposed in said cavity in conductive engagement with said end caps;

leads disposed exterior said body portion projecting from said end caps; and, a thermoplastic coating encapsulating said body portions and end caps such that said leads project outward through said coating.

4. The miniature fuse of claim 3, wherein said fuse wire and end caps are conductively engaged with solder.

5. The miniature fuse of claim 3 wherein said plastic coating is uniform coating.

6. The miniature fuse of claim 3, wherein said leads are staked to said end caps.

7. The miniature fuse of claim 3, wherein said thermoplastic coating has sufficient strength to withstand internal pressures generated in said cavity during an interruption of an inductive circuit.

8. The miniature fuse of claim 7, wherein the inductive circuit is a 125 v, 50 amp, 97% power factor short circuit.

9. The miniature fuse of claim 3, wherein said thermoplastic coating forms a cylindrical body having tolerances of ±0.002 inches.

10. The miniature fuse of claim 3, wherein said thermoplastic coating will withstand temperatures up to 250° F.

11. The miniature fuse of claim 3, wherein said thermoplastic coating increases the impact and flexural strength of said body portion.

12. The miniature fuse of claim 3, wherein said thermoplastic coating completely seals said body portion and conductive caps against moisture.

13. The miniature fuse of claim 3, wherein said thermoplastic coating improves short circuit performance by reducing total $i^2t$ energy.

* * * * *

UNITED STATES PATENT AND TRADEMARK OFFICE

CERTIFICATE OF CORRECTION

PATENT NO. : 4,893,107

DATED : January 9, 1990

INVENTOR(S) : John M. MONTER

It is certified that error appears in the above-identified patent and that said Letters Patent is hereby corrected as shown below:

FRONT PAGE:

The name of the inventor should be --John M. Monter--.

Item [19]: "Moner" should read --Monter--

Signed and Sealed this

Nineteenth Day of February, 1991

*Attest:*

HARRY F. MANBECK, JR.

*Attesting Officer*

*Commissioner of Patents and Trademarks*

US004893107B1

REEXAMINATION CERTIFICATE (2772th)

United States Patent [19] [11] B1 4,893,107

Monter [45] Certificate Issued Jan. 9, 1996

[54] AXIAL MINIATURE FUSE WITH PLASTIC MOLDED BODY

[75] Inventor: John M. Monter, Ballwin, Mo.

[73] Assignee: Cooper Industries, Inc., Houston, Tex.

Reexamination Request:
No. 90/003,428, May 10, 1994

Reexamination Certificate for:

| | |
|---|---|
| Patent No.: | **4,893,107** |
| Issued: | **Jan. 9, 1990** |
| Appl. No.: | **139,359** |
| Filed: | **Dec. 30, 1987** |

Certificate of Correction issued Feb. 19, 1991.

Related U.S. Application Data

[63] Continuation-in-part of Ser. No. 31,489, Mar. 27, 1987, abandoned.

[51] Int. Cl.[6] ..... H01H 85/02

[52] U.S. Cl. ..... 337/186; 337/205; 174/52.2

[58] Field of Search ..... 337/186, 414, 337/205, 251, 252, 241, 246; 174/52 PE, 52 L

[56] References Cited

U.S. PATENT DOCUMENTS

| | | | |
|---|---|---|---|
| 4,385,281 | 5/1983 | McAlear et al. | 337/186 |
| 4,751,489 | 6/1988 | Spaunhorst | 337/260 |
| 4,918,420 | 4/1990 | Sexton | 337/205 |

FOREIGN PATENT DOCUMENTS 51-115541 3/1975 Japan .

*Primary Examiner*—Lincoln Donovan

[57] ABSTRACT

An improved electrical fuse having axial leads (5) and comprising a fuse wire in a cylindrical sleeve (2) supported at its ends by lead carrying end caps (3) is coated over the length of the fuse body by an insulating layer of thermoplastic (7). Improved humidity resistance and mechanical strength are achieved and control of coating thickness is improved. Use of hot plastic for the insulating layer (7) reflows solder joint (4) reducing instances of open or high resistance fuses which must be rejected. Also, the $I^2t$ performance is significantly improved over other adherent coatings.

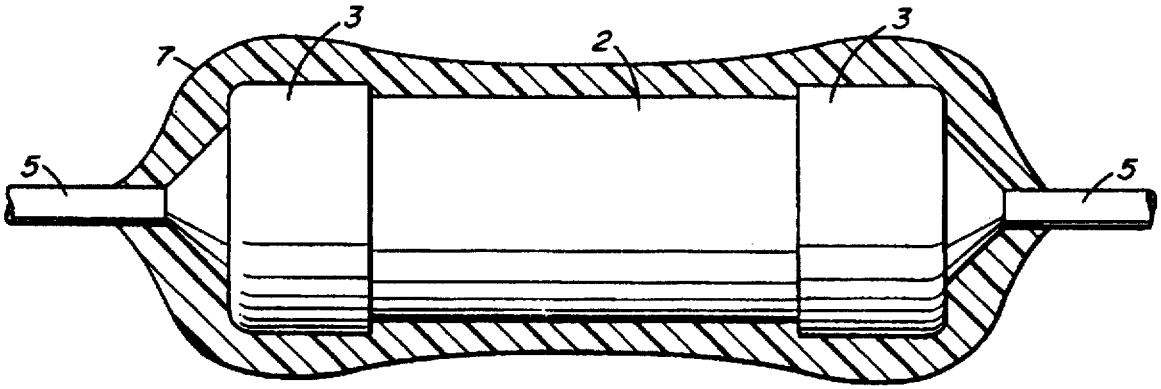

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 4 is cancelled.

Claims 1 and 3 are determined to be patentable as amended.

Claims 2 and 5–13, dependent on an amended claim, are determined to be patentable.

1. A fuse comprising:

an oppositely open ended insulating housing in the form of a cylindrical sleeve;

a fusible element disposed within said housing; and a pair of end cap means closing the ends of said sleeve, securing the ends of said fusible element and making electrical contact thereto, each of said cap means being cup-shaped to provide a cylindrical recess to accommodate an end of said sleeve and having an external lead connected thereto and extending outwardly therefrom for making external electrical connection to said fusible element; each of said cap means containing a quantity of solder fused to make electrical contact between said end cap means and said ends of said fusible element, said fusible element extending diagonally across the length of said sleeve housing and having a portion of each of its ends exiting the open ends of said sleeve and folded back over a portion of the external surface of said sleeve to be located between the sleeve ends and the end cap means; and an *injection-molded* insulating high temperature, resilient coating layer disposed over said sleeve, end cap means and leads to cover, seal, and physically interconnect the exposed exterior surfaces of said sleeve, said pair of end cap means, and a portion of each of said leads adjacent to said pair of end cap means, *said quantity of solder which makes said electrical contact between said end cap means and said ends of said fusible element defining a reflowed solder joint reflowed by heat from said injection-molded layer.*

3. A miniature fuse, comprising:

an insulative body portion having a cavity therein;

conductive caps disposed on said body portion enclosing said cavity;

a fuse wire disposed in said cavity *and fused to said end caps by solder so as to be* in conductive engagement with said end caps;

leads disposed exterior said body portion projecting from said end caps; and,

[a] *an injection-molded* thermoplastic coating encapsulating said body portions and end caps such that said leads project outward through said coating, *said solder which fuses said fuse wire to said end caps defining a reflowed solder joint reflowed by heat from said injection-molded coating.*

* * * * *